United States Patent [19]

Newton, Jr. et al.

[11] 3,957,060

[45] May 18, 1976

[54] TOBACCO TREATMENT

[75] Inventors: Richard P. Newton, Jr.; Robert Reiner Johnson, both of Louisville, Ky.

[73] Assignee: Brown & Williamson Tobacco Corporation, Louisville, Ky.

[22] Filed: Nov. 23, 1971

[21] Appl. No.: 201,452

[52] U.S. Cl. ..... 131/17 R

[51] Int. Cl.[2] ..... A24B 3/14; A24B 13/00; A24B 15/08

[58] Field of Search ..... 131/2, 4, 9, 15, 17, 131/140–144, 10 R, 261

[56] References Cited

UNITED STATES PATENTS

| | | | |
|---|---|---|---|
| 2,171,986 | 9/1939 | Poetsohke | 131/15 R |
| 3,047,431 | 7/1962 | Bavley et al. | 131/17 R |
| 3,517,672 | 6/1970 | Michelson | 131/140 B |
| 3,608,560 | 9/1971 | Briskin et al. | 131/2 |
| 3,638,660 | 2/1972 | Davis | 131/2 |

FOREIGN PATENTS OR APPLICATIONS

| | | | |
|---|---|---|---|
| 6,503,794 | 9/1965 | Netherlands | 131/10 R |
| 908,439 | 10/1962 | United Kingdom | 131/17 |

*Primary Examiner*—Robert W. Michell
*Assistant Examiner*—V. Millin
*Attorney, Agent, or Firm*—Finnegan, Henderson, Farabow & Garrett

[57] ABSTRACT

This invention relates to a tobacco treatment in which the perceived strength of tobacco smoke is improved by treatment of acidic tobacco with a material which remains essentially inactive until the tobacco is burned. The treatment is particularly effective on acidic tobacco to be employed in high filtration cigarettes which deliver reduced amounts of tar and nicotine.

4 Claims, 1 Drawing Figure

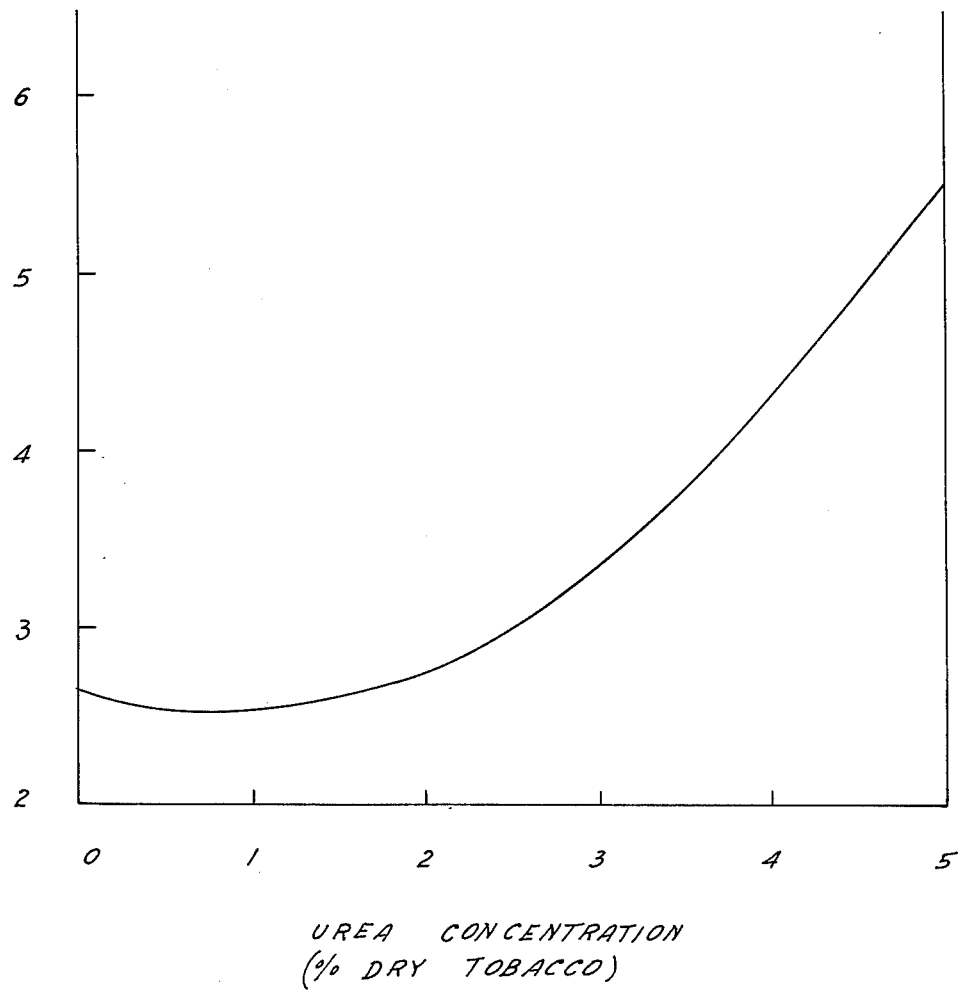
6
5
4
3
2
0
1
2
3
4
5
UREA CONCENTRATION
(% DRY TOBACCO)

TOBACCO TREATMENT

BACKGROUND OF THE INVENTION

Much work has been accomplished of late in providing improved filters for smoking products, such as cigarettes. In general, the effect of such filters is to materially reduce the amount of total particulate matter transmitted with the smoke from the burning tobacco to the smoker. While many of these filtration developments are quite effective, they cannot be used, practically, as the smoke which is ultimately delivered to the smoker is so devoid of those materials which provide satisfaction to the smoker that they are not salable.

It has long been known that certain additives to tobacco can increase the perceived strength of the tobacco smoke. However, the materials of the prior art, particularly alkaline inorganic salts, adversely affected the taste of the tobacco smoke and thus were of little value. These alkaline salts also tended to degrade the tobacco over the storage periods normally encountered and, thus, provided little benefit.

SUMMARY OF THE INVENTION

In accordance with the present invention it has unexpectedly been discovered that the treatment of acidic tobacco with certain non-volatile, organic compounds, in limited amounts, causes an increased level of perception of both strength and satisfaction from a given smoke. By providing these increased levels of perception, high efficiency filters for tobacco products can be employed with the consequent lower deliveries of total particulate matter, but without loss of smoking satisfaction.

In particular, the use of urea and related compounds, particularly biuret, placed on the tobacco in any desired manner, in amounts of from greater than 1% to about 5% has been found effective. The preferred compound is urea. Each of these compounds remains inactive when placed upon the tobacco and does not materially affect the pH of the tobacco or the chemistry thereof, but will increase the pH of the total particulate matter delivered upon smoking. Increased levels of strength perception and satisfaction are found due, in part, to this increase in the pH of the total particulate matter delivered.

BRIEF DESCRIPTION OF THE DRAWING

The accompanying drawing illustrates the levels of strength perception and satisfaction experienced by trained smokers compared with the amount of urea placed on the tobacco in accordance with the present invention.

DESCRIPTION OF THE PREFERRED EMBODIMENTS

The use of urea, for example, has previously been suggested for reduction of nitrosamines in smoke. This is disclosed in South African Pat. No. 641,432, published on Mar. 25, 1964. However, the amounts were limited to from 0.01 to 1% and further testing has indicated that this limitation was required as additional amounts do not have the desired effect of reducing the nitrosamines.

The materials of the present invention, particularly urea, are applied by any desired method. For example, aqueous solutions of the material conaining from 2.5 to 50.0% of the treating agent can be sprayed onto the tobacco to provide the desired quantity of agent on the tobacco. The tobacco, prior to treatment, may be dry or may contain any desired quantity of moisture, so long as, after application of the additive, the tobacco is dried, by known methods, to yield the desired moisture level of, say, 10 to 20%. No other treatments, other than those generally employed for tobacco processing, are necessary to effectuate the advantages of the present invention. The particular temperature of treatment, either for application of the material or for ultimate conditioning of the tobacco, is not important and the conditions which generally apply for drying or redrying of tobacco can be used. The non-volatile, organic compounds of the present invention are generally applied to the tobacco to effect a final concentration of from greater than 1 to approximately 5%, by weight. Preferably, the amounts are from about 2 to 4%, by weight, based upon the weight of the tobacco.

In order that those skilled in the art may be better enabled to practice the present invention, the following examples are given as illustrations. These examples should not be considered as limiting in any way the invention as covered in the appended claims. All parts in these examples, unless otherwise stated, are by weight.

EXAMPLE 1

This example illustrates that there is no degradation of the tobacco following treatment with the materials of the present invention. Two samples of the same tobacco blend were treated, the first with a 17.5% aqueous solution of urea to accomplish a 5% urea deposition, and the second with water, but in the same manner. Each of the tobacco samples, following treatment, had a pH of about 5.0. The following were analyses of selected components of the tobacco, first after drying to a 13–14% moisture content, and finally after 13 weeks aging:

TABLE I

| | After Treatment and Redrying | | | | After 13 Weeks Aging | |
|---|---|---|---|---|---|---|
| | % Total Alkaloids | % Sugar Reducing | % Sugar Total | pH | % Total Alkaloids | % Sugar Reducing Total |
| Control Tobacco Blend with 5% Urea | 2.28 | 12.6 | 14.6 | 5.1 | 2.30 | 12.9 |
| | 2.14 | 11.2 | 13.5 | 5.1 | 2.28 | 12.1 |
| Untreated Tobacco | 2.36 | 13.4 | 15.6 | 5.1 | 2.39 | 14.5 |

Thus, it can easily be seen that there is little if any change in the tobacco based upon either a control or an untreated sample.

EXAMPLE 2

Cigarettes were formed from the water treated control and tobacco containing 5% urea as described in Example 1. The formed cigarettes were smoked on a constant vacuum smoking machine taking one puff per minute with a two second puff duration, and a 35 ml. puff volume. The results of the tests were as follows:

TABLE II

| Component | Control | Cigarette with 5% Urea Addition |
|---|---|---|
| Puffs | 7.8 | 8.9 |
| Tar (mg) | 24.4 | 23.1 |
| Nicotine (mg) | 1.98 | 2.06 |
| Acetaldehyde (micrograms) | 509 | 279 |
| pH of Total Particulate Matter | 5.3 | 7.3 |

Thus, it can be seen that the total particulate matter in the smoking resulting from the tobacco treated with 5% urea has a significantly increased pH, while the smoke has decreased acetaldehyde. Additionally, while there is an increase in puff number, the total tar delivery is decreased. Obviously, therefore, there is also a decrease in the per puff delivery of the various materials.

The cigarettes of this example were also subjectively evaluated by a panel of smokers trained to distinguish between and measure the perceived strength and irritation of cigarette smoke.

The cigarette treated with 5% urea was rated as having substantially increased strength and satisfaction without a concomitant increase in irritation, as compared to the water treated control.

EXAMPLE 3

Further test cigarettes were made with high efficiency paper filters. One group of cigarettes had a quantity of urea added at a 1.25% level, while the other cigarettes were identical except for the lack of urea. A panel of cigarette smokers trained as described in Example 2 reported that the cigarettes with added urea provided a stronger, more satisfying, and more balanced smoke than the control cigarette. Similar results were obtained with urea added at 4% levels employing a cellulose acetate filter.

EXAMPLE 4

Two pound samples of cut tobacco blend were dusted with a quantity of biuret to achieve a deposition level of 1.25% (wt./wt.). Cigarettes were formed from this tobacco. The pH of the smoke particulate phase was determined as in Example 2 (Table IV). This sample, along with control, was subjectively evaluated by a panel of cigarette smokers as described in Example 2. The panel reported that the cigarette with 1.25% added biuret provided a stronger, more satisfying, and more balanced smoke than the control cigarette. The results of the analytical tests were as follows:

TABLE IV

| | Percent | | | | |
|---|---|---|---|---|---|
| | Total Alkaloids | Reducing Sugar | Total Sugar | Tobacco pH | pH of Total Particulate Matter |
| Control | 1.94 | 8.52 | 10.63 | 5.3 | 5.7 |
| 1.25% Biuret | 1.94 | 8.46 | 10.87 | 5.3 | 5.9 |

EXAMPLE 5

A series of cigarettes were formed with urea applied in amounts of 0.5%, 1.25%, 2.50%, 3.75%, and 5.0%. These cigarettes, along with a control cigarette containing no urea, were evaluated by a panel of trained smokers as to strength perception and satisfaction. Numerical values were assigned to the strength perceptions and satisfaction noted by these trained smokers and the results of the study are graphically illustrated in the accompanying FIGURE. From a review of the FIGURE it can be seen that application of urea at just above the 1% level results in some increase in the strength perception and satisfaction realized. At about the 2% level, this increase in strength perception and satisfaction becomes particularly significant.

In accordance with the present invention the treatment of tobacco for use in smoking products, particularly cigarettes, with materials which do not affect the tobacco prior to smoking, but which provide smoke with increased strength and satisfaction have been described. Such treatments are particularly valuable for tobacco used in conjunction with high efficiency filters.

We claim:

1. A tobacco product produced from a tobacco treated with an organic material selected from the group consisting of urea and biuret in an amount within the range of from about 1.25% to about 5% by weight which has no significant chemical effect upon the unburned tobacco but which is sufficient to increase the level of strength perception of the smoke resulting from burning of the tobacco.

2. The tobacco product of claim 1 in which the tobacco has applied thereto from 2% to 5% by weight of said organic material.

3. The product of claim 2 wherein said tobacco product is treated with urea.

4. The tobacco product of claim 3 employed as the smoking charge of a cigarette having a high efficiency filter attached thereto.

* * * * *